United States Patent [19]

Calvano

[11] 4,377,097

[45] Mar. 22, 1983

[54] SHUTTLE MACHINE TOOL

[76] Inventor: Joseph E. Calvano, 10542 Walden Pkwy., Chicago, Ill. 60643

[21] Appl. No.: 132,508

[22] Filed: Mar. 21, 1980

Related U.S. Application Data

[63] Continuation-in-part of Ser. No. 12,870, Feb. 16, 1979, abandoned.

[51] Int. Cl.[3] ..... B26F 1/06

[52] U.S. Cl. ..... 83/98; 83/124; 83/125; 83/141; 83/319; 83/387

[58] Field of Search ..... 83/98, 99, 140, 141, 83/308, 318–320, 387, 128, 124, 125

[56] References Cited

U.S. PATENT DOCUMENTS

| | | | |
|---|---|---|---|
| 519,293 | 5/1894 | Rockwell et al. | 83/140 X |
| 2,595,305 | 5/1952 | Scott | 83/141 X |
| 3,075,422 | 1/1963 | Shultz | 83/319 |
| 3,322,011 | 5/1967 | Kocian | 83/320 X |
| 3,501,985 | 3/1970 | Baran | 83/689 X |
| 3,537,348 | 11/1970 | Robins | 83/319 |
| 3,656,385 | 4/1972 | Kimbrell | 83/319 X |
| 3,704,643 | 12/1972 | Cookson | 83/319 X |
| 3,939,743 | 2/1976 | Coombes | 83/98 |

FOREIGN PATENT DOCUMENTS

| | | | |
|---|---|---|---|
| 368053 | 5/1961 | United Kingdom | 83/319 |

*Primary Examiner*—James M. Meister

*Attorney, Agent, or Firm*—Leydig, Voit, Osann, Mayer & Holt, Ltd.

[57] ABSTRACT

A method and apparatus for automatically performing work operations, such as the punching of apertures, on moving web materials. The apparatus includes a chassis that is mounted for limited movement in the direction of web travel. The chassis includes a clamping plate and a base plate which are selectively brought into clamping engagement with the web, which enables the chassis to be moved along with the web. Subsequently, a tool is drawn into engagement with the web to perform the work operation. Upon completion of the work operation, the tool is removed from the vicinity of the web, the web is released by the chassis clamping and base plates, and the chassis is returned to its original position.

6 Claims, 7 Drawing Figures

SHUTTLE MACHINE TOOL

DESCRIPTION OF THE INVENTION

This is a continuation-in-part of application Ser. No. 12,870, filed Feb. 16, 1979, now abandoned.

The present invention relates to automatic machine tools such as punch machines, and more particularly to such machines which are adapted to operate upon a moving web of material.

In all phases of manufacturing processes it is customary to successively perform steps of the manufacturing process on uninterrupted stock or a web of material which is advanced through the manufacturing line. Although some manufacturing steps lend themselves to functioning on a moving web (such as longitudinal cutting, folding, gluing and the like) the process of punching holes or similar openings in a moving stock has created problems. Once the punch has passed through the material, it has tendency to cause the moving stock to catch or become stuck on the punch such that the punch is either damaged or movement of the stock is impeded in an undesirable way. These problems particularly arise during high speed operations or operations where relatively thick stock material is being punched. Moreover, when relatively thin or fragile webs are being run, problems also have ocurred in coordinating the punching operation without damage to the web.

To overcome such problems, in many instances it has been found necessary to stop the advance of the material during each punching operation. Such interruption in the manufacturing line not only is uneconomical but also can impede other continuous operating steps in the line. Others have attempted to use a ball or round-ended punch which operates with a shallow concave die having a sharp cutting edge around its periphery. Such punches, however, have only been suitble for relatively thin materials, and in addition, after prolonged use the cutting edges of the die become worn and dulled so as to impede reliable and effective punching.

It is therefore an object of the present invention to provide an automatic punch machine adapted to successively and effectively operate upon a moving web or stock of material.

Another object is to provide an automatic machine as characterized above which is adapted to punch holes in a moving web without impeding the continuous web movement.

A further object is to provide an automatic machine of the above kind that is adapted to efficiently operate on thick web materials, as well as relatively thin webs made from plastic or other materials that can be easily damaged in high speed handling.

Other objects and advantages of the invention will become apparent from the following detailed description and upon reference to the drawings, in which.

Figure 1:
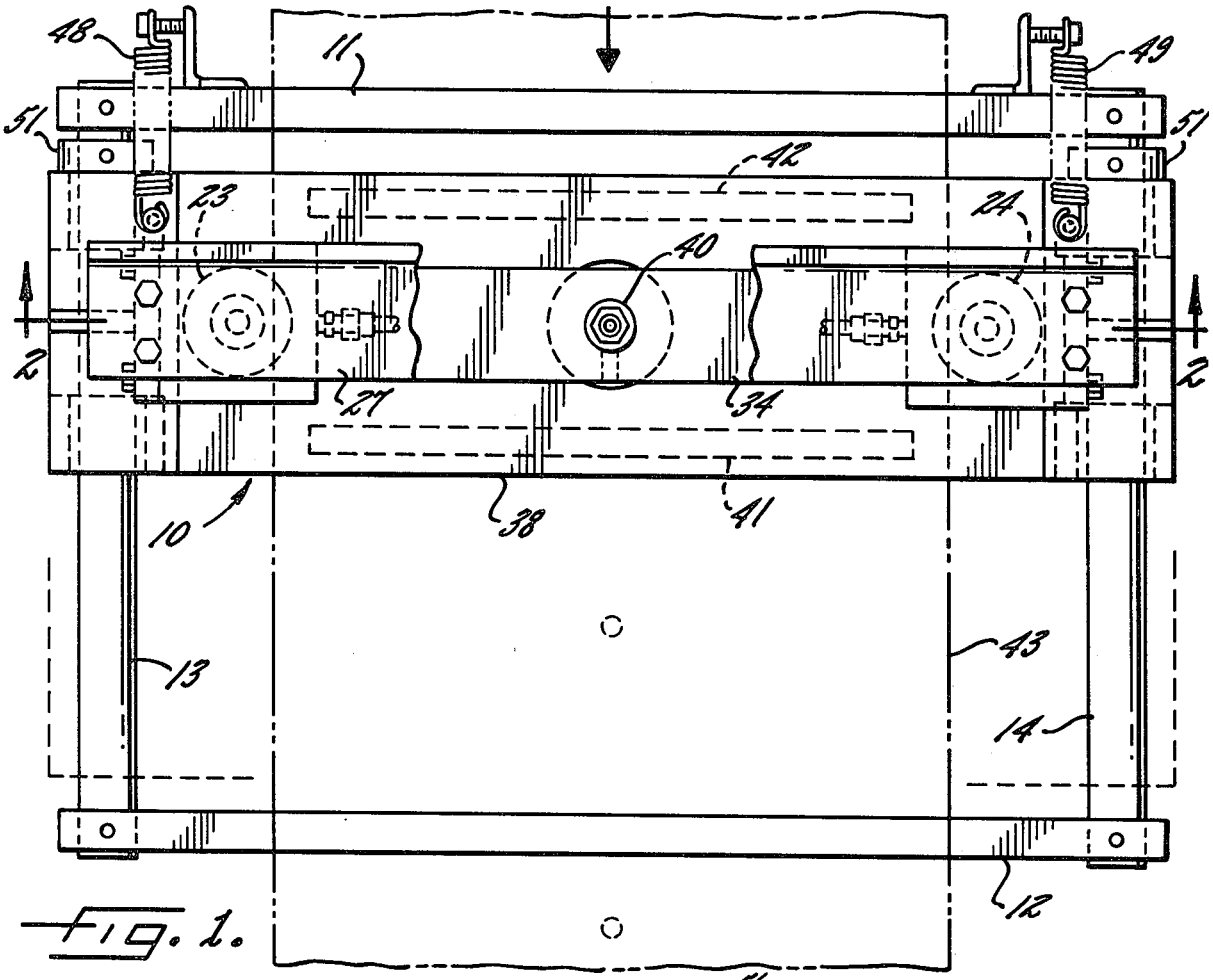
FIG. 1 is a plan view of a preferred apparatus according to the present invention.

While the invention is susceptible of various modifications and alternative constructions, an illustrative embodiment has been shown in the drawings and will be described below in detail. It should be understood, however, that there is no intention to limit the invention to the specific forms disclosed, but, on the contrary, the intention is to cover all modifications, alternative constructions and equivalents faling within the spirit and scope of the invention.

Referring now more particularly to the drawings, there is shown an illustrative punching machine 10 embodying the present invention which is shown performing work on a moving web of material, such as a relatively thin plastic web having a thickness as low as 0.0007 inches. The machine includes a rear frame member 11 and a front frame member 12 on which are mounted guide rods 13 and 14. A chassis 16 is slidably mounted on the guide rods 13 and 14 for limited translational travel in the direction of the web movement. The chassis 16 in this case has a frame construction consisting of a base plate 19, side walls 21, 22 and an upper ledge 27, all preferably made of aluminum so as to minimize the weight of the chassis. To permit movement of the chassis on the rods 13, 14 the chassis has a pair of support blocks 17 that ride on linear ball bearings 18 on the guide rods. The linear ball bearings 18, which may be of a commonly available type such as sold by Thomson Industries Inc., permit the chasssis 16 to ride on the guide rods 13, 14 with relatively little frictional resistence.

In accordance with the invention, the chassis is adapted to engage the web for limited movement with the web, perform a work operation on the web as it is moving, and then release the web and return to its original position. To this end, the chassis includes a clamping plate 38 which is normally held in parallel spaced relation to the base plate 19 to define a passageway for the moving web, a tool-bearing plate 34 mounted in parallel spaced relation to the clamping plate 38, and means including cylinders 23, 24 for selectively moving the clamping plate 38 and tool-bearing plate 34 toward and away from the base plate. Springs 36, 37 are interposed between the clamping plate 38 and tool-bearing plate 34 to maintain a resilient separation therebetween. The tool-bearing plate 34 in this instance carries a sawtooth punch 44 in a punch holder sleeve 40, with the lower end of the punch 44 being disposed in an aperture in the clamping plate for relative movement.

For effecting movement of the clamping plate 38 and tool-bearing plate 34 relative to the base plate 19, the cylinders 23, 24 are mounted on the side walls 21, 22 by appropriate fasteners 26 and have respective piston shafts 29, 31 coupled to the plates 34 and 38. The shafts 29, 31 in the illustrative embodiment pass through the tool-bearing plate 34 and clamping plate 38 with the ends thereof being received in guide bushings 30, 35 in the base plate 19. The piston shafts 29, 31 are driven up and down in their respective cylinders by compressed air supplied to a valve assembly 28 mounted on the upper chassis ledge 27.

Upon a downward stroke of the piston shafts, (as viewed in the drawings) shoulders 32 and 33 fixed to the shafts of the respective cylinders drive the tool-bearing plates 34 downwardly, which by the action of springs 36 and 37 moves clamping plates 38 downwardly while maintaining clamping plate 38 and tool-bearing plate 34 in a spaced-apart relationship initially. Due to the action of springs 36 and 37, tool-bearing plate 34 and clamping plate 38 will remain in a spaced-apart relationship until clamping plate 38 is driven into proximity with base plate 19.

In order to permit gripping of the web by the chassis when the chassis is lowered by the cylinders, the upper surface of base plate 19 is provided with a size plate 39, and affixed within recesses along the clamping plate are two strips of rubber 41 and 42. When clamping plate 38 and base plate 19 are driven toward one another, the rubber strips 41 and 42 are pressed against the upper surface of moving web 43 while the size plate 39 bears against the lower surface of moving web 43, clamping the chassis to the moving web. Upon such clamping, the chassis will begin to move along the guide rods 13, 14 with the web.

After the chassis has engaged and is moving with the web, further driving movement of the cylinder pistons will effect the punching operation on the web. As the cylinder shafts continue to move downwardly upon actuation of the cylinders, the shoulders 32, 33 of the piston shafts will continue to drive the too-bearing plate downwardly overcoming the resistance of the springs 36, 37.

Figure 4:
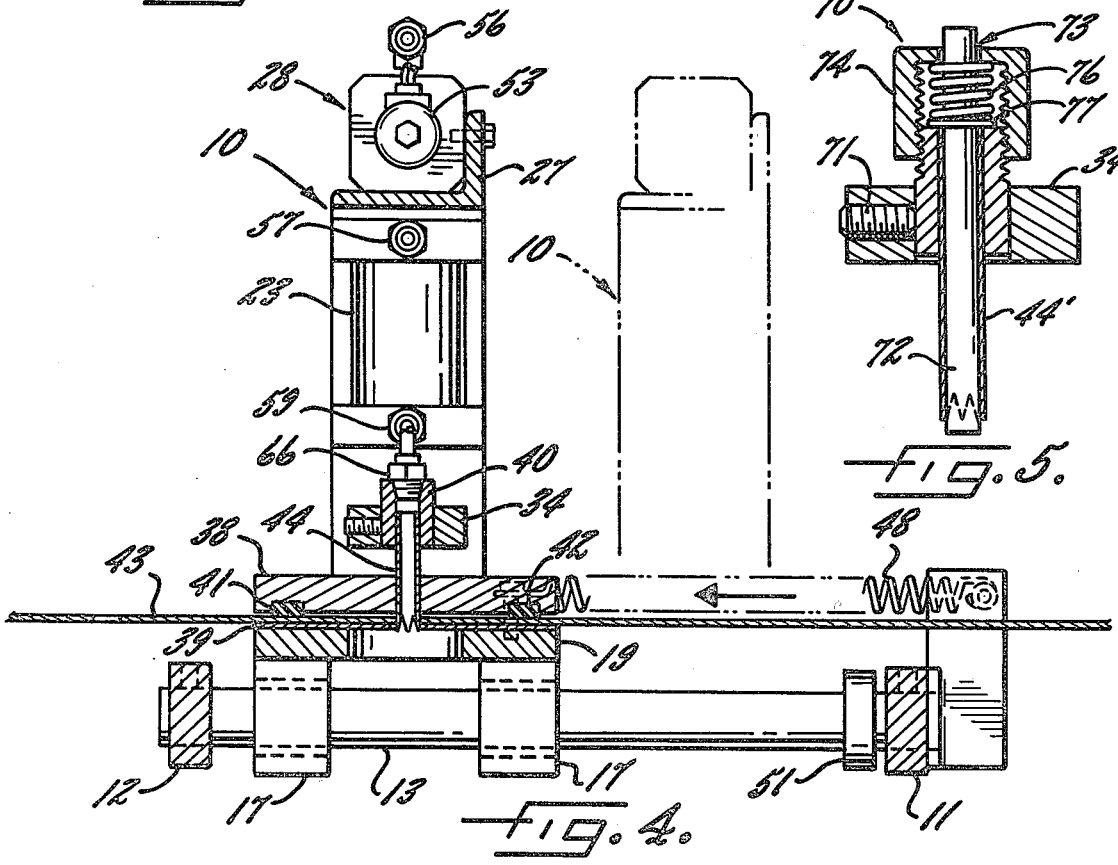
FIG. 4 is taken along 4—4 of FIG. 3 and shows the movement of the punch assembly along the guide rods.

To formulate successive punching operations on the web, means are provided for disengaging the chassis from the web and returning the chassis to its initial position. When piston shafts 29 and 31 return upwardly through the action of valve assembly 28, to be described hereinafter, shoulders 46 and 47 raise clamping plate 38 above base plate 19, and the cooperating rubber strips and size plate release the moving web while spring 36 raises the tool-bearing plate 34 with tool 44 further above clamping plate 38. This removes the head of the tool and the clamping and base plates. Further movement of the chassis assembly 16 in the direction of the moving web 43 ceases, and a pair of extension springs 48 and 49 (FIGS. 1 and 4) return the chassis, in a direction opposite to the direction of the motion of the web 43, to its original position. A pair of stops, such as 51 (FIG. 4) on rod 13, limit the rearward movement of the chassis assembly 16.

Figure 3:
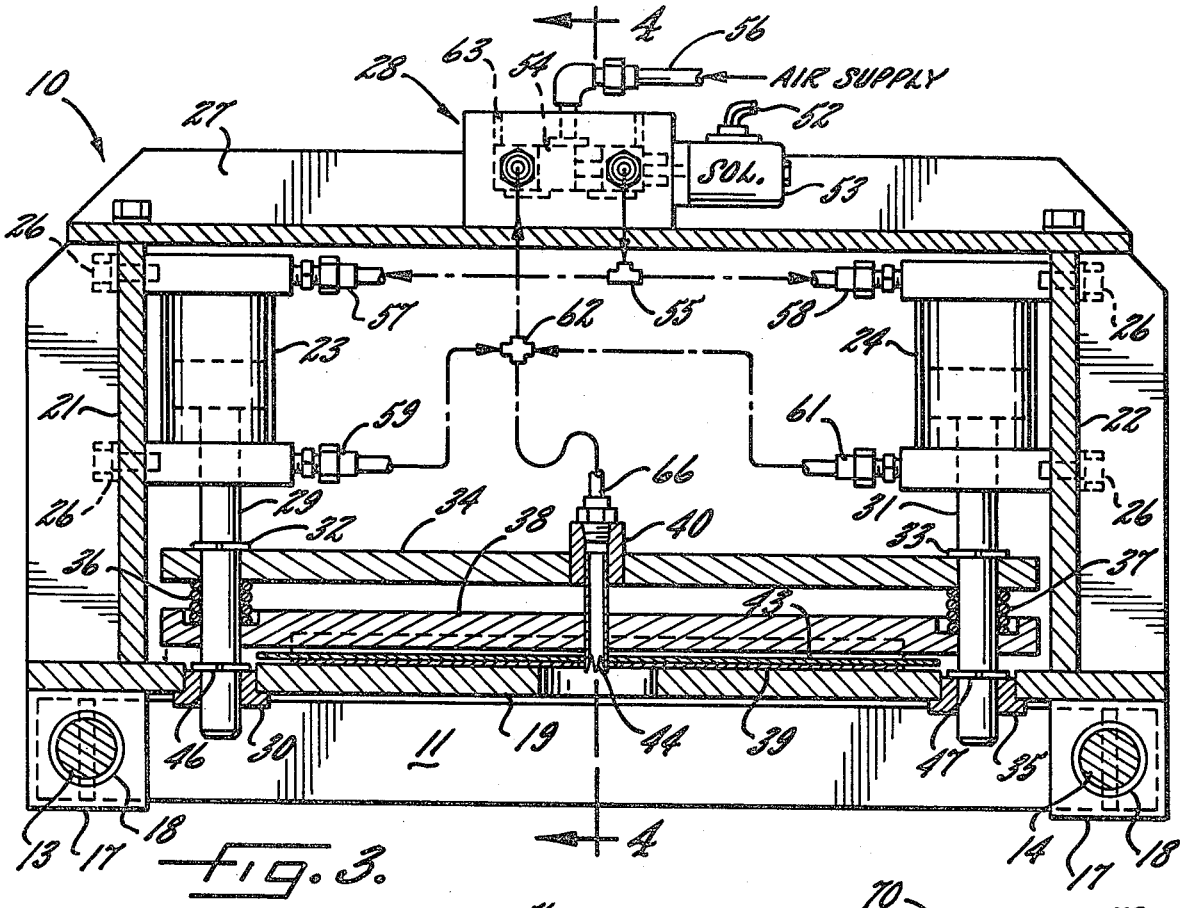
FIG. 3 is similar to FIG. 2 except that the punch is lowered into the moving stock.

The illustrated compressed air system for actuating the cylinders 23 and 24 includes a solenoid 53 with the control signals to the solenoid being generated by, for example, an automatic control, an individual operator, limit switches on the assembly, or other means, directed to the solenoid through a line 52. Downward drive of cylinder shafts 29 and 31 is provided as shown in FIG. 3 with solenoid 53 activated through connection 52 to move a plunger 54 to the left within valve assembly 28. Compressed air from a source (not shown) is coupled through an input line 56 and valve assembly 28, through a T connection 55, and through fittings 57 and 58 into the upper portions of cylinder 23 and 24, respectively. This forces shafts or plungers 29 and 31 downwardly into the configuration illustrated in FIG. 3. The air in the lower portions of cylinders 23 and 24 is released during the downward stroke of the shafts 29 and 31 through fittings 59 and 61, a connector 62, and a duct 63 in valve assembly 28.

Figure 2:
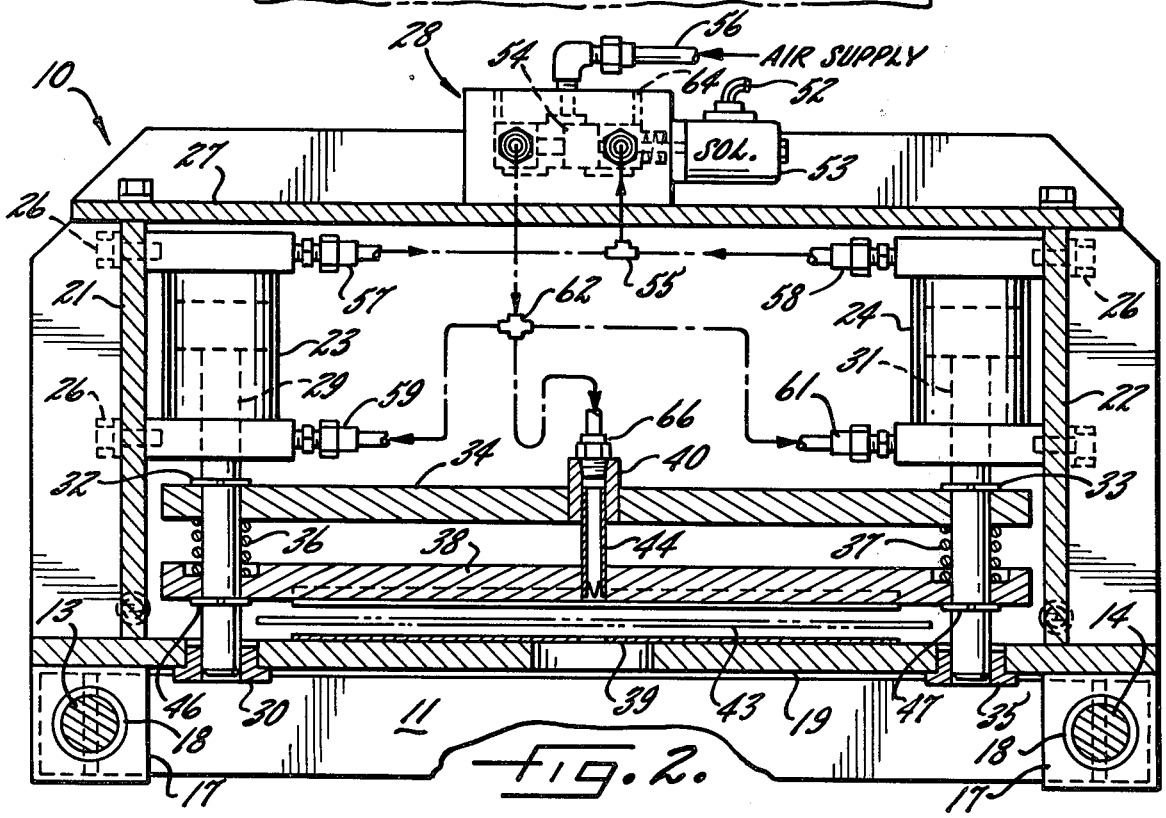
FIG. 2 is a sectional view taken along 2—2 of FIG. 1 showing the punch in the raised position.

The compressed air system also operates to drive the pistons in cylinders 23 and 24 upwardly to disengage the chassis and the punch from the web, permitting the chassis to be returned to its original position. With reference to FIG. 2, in reponse to an appropriate control signal signifying the end of a punching operation, solenoid 53 moves plunger 54 to the right, coupling the compressed air input through connector 62 to the lower portions of cylinders 23 and 24. Simultaneously, the air from the upper portions of the cylinders is vented through connector 55 and vent port 64 in valve assembly 28. Coupling the compressed air to the lower portions of cylinders 23 and 24 drives the tool-handling plate 34 and clamping plate 38 upwardly.

A further aspect of the compressed air system as illustrated in FIG. 2 is the provision of compressed air to eject the punched piece of material, which has been punched from the web, out of the interior of punch 44. In order to accomplish this, at the same time as compressed air is coupled to the lower portions of cylinders 23 and 24 to drive the toolhandling plate and clamping plate upwardly, air is also supplied through fitting 66 to tool 44. This surge of compressed air blows the just-punched piece of material out of the lower portion of the hole punch 44.

Figure 5:
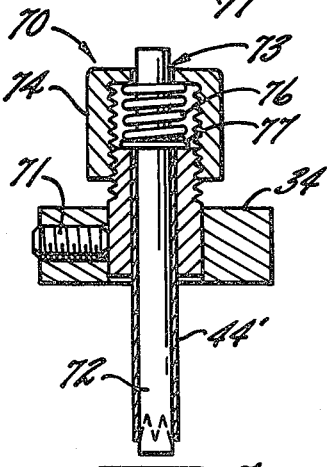
FIG. 5 is an enlarged sectional view of an alternative punch assembly.

An alternative punch assembly 70 is shown in FIG. 5 having mechanical means for ejecting punched pieces of material from a punch 44'. In the punch assembly 70, the tool 44' is secured to tool-bearing plate 34 by a set screw 71 and is driven by the tool-bearing plate 34 in the same manner described above. In order to remove a punched piece of material from the lower portion of punch 44', in this case a plunger 72 is provided, which prior to a punching operation is disposed as indicated in FIG. 5 with its lower end extending below the bottom of punch 44'. The plunger 72 includes a shoulder or snap ring 77 resting on the upper portion of punch 44'. The shoulder 77 is maintained against the punch by a coil spring 76 which also bears against an adjustment cap 74. The adjustment cap is threadably received on punch 44' to enable adjustment of the tension of the coil spring 76 and is apertured to allow the upper end 73 of the plunger 72 to pass therethrough.

When the head of punch 44' engages the web 43, the plunger 72 is moved upwardly relative to punch 44' against the force of coil spring 76. After the punch 44' has punched a piece of material from the web 43, the coil spring 76 urges the shoulder 77 of the plunger 72 downwardly onto the top of the punch 44', pushing the lower end of the plunger 72 through the bottom of the punch 44', expelling the punched piece of material.

Figure 6:
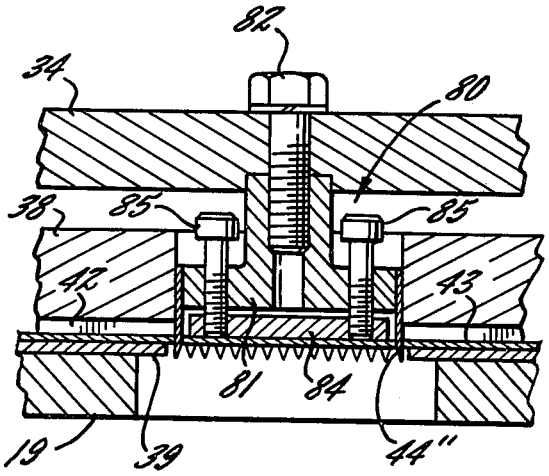
FIG. 6 is an enlarged sectional view of still another alternative punch assembly.
Figure 7:
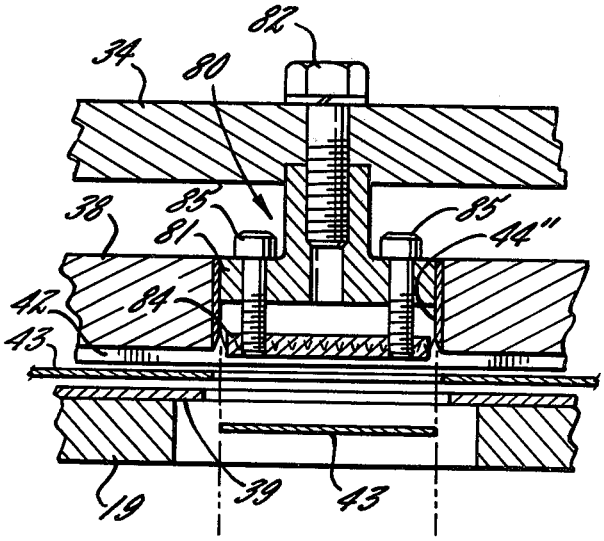
FIG. 7 is similar to FIG. 6 except the ejector plate is extended slightly below the punch teeth.

Still another alternative form of punch assembly 80 is shown in FIGS. 6 and 7, which in this case is adapted to produce relatively larger size holes. The punch assembly 80 includes a hub 81 having a circular array of teeth 44" about its outer periphery. The punch assembly is secured to the underside of the tool-bearing plate 34 by a bolt 82 that threadibly engages an upper extension of the hub 81, and the clamping plate 38 is formed with an aperture for receiving the hub for relative vertical movement.

For ejecting a punched blank after each working stroke, an ejector plate 84 is suspended from the underside of the hub 80 by socket head bolts 85 for limited vertical movement with respect to the hub 81. The ejector plate 84 is moveable from a position completely contained within the punch teeth, as shown in FIG. 6, to a position extending slightly below the teeth, as shown in FIG. 7. It will be seen that as the tool-bearing plate 74 moves the punch teeth 44" into engagement with the web 43, the ejector plate 84 will be moved upwardly within the teeth as the teeth pierce the web (FIG. 6). After the punch teeth pass through the web, the weight of the ejector plate 84 will cause it to fall downwardly beyond the ends of the teeth (FIG. 7) expelling the punched blank.

In operation, the punching machine 10 performs successive punch operations upon a moving web of material 43 as follows. The clamping plate 38 and base plate 19 are driven together, seizing the moving web 43 of material therebetween. With the web 43 gripped between plates 38 and 19, chassis 16 moves along with the web along guide rails 13 and 14. While the chassis 16 is moving with the web 43, tool-bearing plate 34 on the chassis is driven downwardly web 43. On this downward movement, punch 44 is driven into the web of material, punching a hole therein. After the punching operation, tool-bearing plate 34 is moved upwardly, moving punch 44 out of engagement with web 43, and plates 38 and 19 are moved apart releasing their grip on web 43. With this release of the web, chassis 16 no longer moves with the web but is returned to its original position for subsequent punching operations.

From the foregoing, it can be seen that an automatic machine tool of the present invention is adapted to successively and effectively operate upon a moving web of material. Since the chassis upon which the tool is mounted is temporarily clamped to the moving web of material during the work operation of the tool, the continuous movement of the web is not impeded. Moreover, because the chassis has a lightweight aluminum construction and is mounted for substantially friction-free movement, it has been found that such chassis can be clamped upon and moved by relatively thin plastic web materials, with gauges in the range of 0.0007 to 0.0300 inches, that are being advanced through the machine at speeds as high as 100 feet per minute. It will be appreciated that while the foregoing embodiment of the invention has been particularly described in conjunction with a punch, other types of tools may be advantageously employed in conjunction with the present invention.

I claim as my invention:

1. An apparatus for performing work operations on a relatively thin web comprising a structural frame through which the web is advanced, a chassis having a tool bearing element upon which a tool is mounted, means supporting said chassis on said structural frame for movement in the direction said web is advanced, said chassis having web clamping means for temporarily engaging the moving web and causing said chassis to be moved in unison with said web, said clamping means including a movable clamping element and an opposing element between which said moving web passes, said clamping element being disposed between the tool-bearing element and said opposing element and said clamping element being apertured to permit passage of the tool therethrough, engagement means for moving the clamping element toward said opposing element for clamping the moving web therebetween, said engagement means including a drive cylinder mounted on said chassis having a piston shaft passing through the clamping element and tool-bearing element, a spring yieldably separating the tool-bearing element from the clamping element, and means for actuating said drive cylinder for driving said clamping element into clamping engagement with the web and then for further driving said tool-bearing element against the biasing force of said spring separating said tool-bearing element and said clamping element to effect a work operation on said web while said clamping means is in engagement with said web; and means for unclamping said clamping means and returning said chassis to an original position after completion of said work operation.

2. The apparatus of claim 1 in which said frame includes a pair of guide rods extending parallel to the direction of movement of the web of material, and said chassis support means includes linear ball bearing means which support said chassis for substantially friction-free movement on said guide rods.

3. The apparatus of claim 1 in which said tool is a punch that is adapted to form a predetermined sized aperture in said web during each work operation.

4. The apparatus of claim 3 in which said punch has a hollow head configuration that receives the punched material during each work operation, and a source of compressed air coupled to said punch, and means for directing air through the punch head after each work operation has been performed whereby material removed from the web is blown out of the tool head.

5. The apparatus of claim 3 in which said punch has a hollow head configuration that receives the punched material during each work operation, and a plunger slidably mounted in said head, and means for yieldably urging the plunger through the head of the punch to expel material removed from the web after each work operation has been performed.

6. The apparatus of claim 1 in which said tool is a punch adapted to form a predetermined size aperture in said web during each work operation, said punch including a hub suspended from said tool bearing element for limited movement relative to said clamping element, said hub having a determined array of vertically disposed teeth, an ejector plate suspended from said hub for vertical movement from a position completely above the ends of said teeth to a position below the ends of said teeth, and said ejector plate being moveable to said upper position as an incident of engagement of said web by said punch during a work operation and upon completion of said work operation said ejector plate being moveable by gravity force to a lower position that ejects the punched web blank.

* * * * *